US006205893B1

(12) United States Patent
Sato

(10) Patent No.: US 6,205,893 B1
(45) Date of Patent: Mar. 27, 2001

(54) SCREWDRIVER PEN

(75) Inventor: Tomohiro Sato, Hong Kong (HK)

(73) Assignee: Marushin Hong Kong Limited (HK)

( * ) Notice: Subject to any disclaimer, the term of this patent is extended or adjusted under 35 U.S.C. 154(b) by 0 days.

(21) Appl. No.: 09/368,266

(22) Filed: Aug. 3, 1999

(51) Int. Cl.[7] ..... B25B 23/00
(52) U.S. Cl. ..... 81/439; 81/490
(58) Field of Search ..... 81/439, 177.4, 81/490

(56) References Cited

U.S. PATENT DOCUMENTS

| | | | | |
|---|---|---|---|---|
| 3,750,729 | * | 8/1973 | Lemieux | 145/64 |
| 4,425,828 | * | 1/1984 | Berdinner, Jr. | 81/57.39 |
| 4,515,046 | * | 5/1985 | Johnson | 81/436 |
| 4,762,036 | * | 8/1988 | Orlitzky et al. | 81/437 |
| 5,325,745 | * | 7/1994 | Koehler | 81/439 |
| 5,337,637 | * | 8/1994 | Bih-Lien | 81/439 |
| 5,509,705 | * | 4/1996 | Woodsum | 294/1.1 |
| 5,673,600 | * | 10/1997 | Yanagi et al. | 81/490 |
| 5,947,212 | * | 9/1999 | Huang | 173/216 |

FOREIGN PATENT DOCUMENTS

| | | |
|---|---|---|
| 63-70881 | 5/1988 | (JP) . |
| 2617698 | 3/1997 | (JP) . |

* cited by examiner

*Primary Examiner*—David A. Scherbel
*Assistant Examiner*—Hadi Shakeri
(74) *Attorney, Agent, or Firm*—Jackson Walker L.L.P.

(57) ABSTRACT

A screwdriver pen has a forward elongate housing containing four side-by-side screwdriver heads that can slide partially out of the housing selectively for use. A separately formed rear housing slidingly supports four respective manually operable actuators. When an actuator is slid forwards it bears against a respective push wire to move a head into a forward position for use. The housings are joined together using an apertured annular collar and a pin. The pin holds the housings together and prevents relative rotation between the housings.

15 Claims, 2 Drawing Sheets

SCREWDRIVER PEN

BACKGROUND OF THE INVENTION

1. Field of the Invention

The invention relates to a multiple screwdriver pen.

2. Description of Prior Art

It is well known to provide a "pen" that contains a number of writing implements that can be selected in turn and are contained in a common cylindrical housing that fits and clips conveniently in a breast pocket, for example. Typically a pencil and ink implement may be provided, or say three different coloured ink implements, in the one housing. The selected implement is then pushed forward and out of one end of the housing and held in position for use. When the writing is finished, the selected implement is retracted into the housing, the "multiple pen" is replaced in a breast pocket, and is readily available for subsequent use.

It has been proposed to use the mechanical arrangement of such multiple writing implements to provide a set of small screwdrivers, herein referred to as a "screwdriver pen", in which the cylindrical housing contains two or more different screwdriver heads that can be selectively partially exposed out of one end of the housing and retracted wholly within the housing when not in use. The requirements for screwdriving, especially the mechanical strength for resisting relative longitudinal and rotational movement of the screwdriver heads and the housing in use, are significantly different to those required for a writing implement. This means that a straight-forward adaption of the writing pen mechanical arrangements do not provide a satisfactory configuration for a screwdriver pen and so far proposed screwdriver pens have not been generally commercially successful probably for this reason.

SUMMARY OF THE INVENTION

It is an object of the invention to overcome or at least reduce this problem.

According to the invention there is provided a screwdriver pen comprising a plurality of different screwdriver heads slidingly supported side by side in a forward elongate housing, a separately formed rear housing that is joined end-to-end to the forward housing and contains for each head a manually operable longitudinally relatively slidable actuator for pushing the head forwards so as to be partially exposed for use out of a remote end of the forward housing, in which an aperture in the remote end is formed to engage over and to rotatably grip the screwdriver head so that turning of the forward housing turns the screwdriver head whenever the screwdriver head is partially exposed, and including a push wire for each screwdriver head that extends between the head and the actuator, and releasable catch means to hold each actuator in a forward position.

The housings are preferably formed of moulded plastics material and a reinforcing band is mounted externally of the forward housing surrounding the aperture.

The forward and rear housing are preferably connected together by a laterally extending pin that prevents relative rotation between the housings.

A spring for each head may be included and arranged to bias the head towards a rear position inside the forward housing so that in use whenever the actuator is released the head retracts from the partially exposed position automatically under the bias of the spring.

An apertured annular collar preferably fits inside the housings for separatingly locating and guiding the push wires in a respective aperture, in which each aperture has a slot extending from the aperture to allow the push wires to enter the apertures sideways from outside the collar.

Inner surfaces adjacent the aperture are preferably chamfered so as to provide guiding surfaces for the heads as they are moved forwards towards the aperture.

External forward surfaces of each head is also preferably chamfered for guiding the head into the aperture whenever the screwdriver head moves forwards towards the aperture. External rearward surfaces of each head are also preferably chamfered.

The releasable catch means may each comprise a ledge on a side of the actuator and a stop fixed in relation to the rear housing, the ledge and the stop having surfaces that can mate against one another to hold the actuator in the forward position, in which a plane of at least one of mating surfaces extends to some extent in a direction away from the forward direction so that strain on the actuator away from the forward position presses the mating surfaces more firmly against one another.

BRIEF DESCRIPTION OF THE DRAWINGS

A screwdriver pen according to the invention will now be described by way of example with reference to the accompanying drawings in which.

DESCRIPTION OF THE PREFERRED EMBODIMENTS

The screwdriver pen comprises an elongate, and usually cylindrical, housing incorporating four different screwdriver heads slidably mounted side by side in the housing. The heads are arranged to be manually selected and pushed forward selectively in turn by respective actuators for use. The screwdriver heads have blades that are of different dimensions or types as would be required by and useful for an electrician, watch maker, handyman and so forth. Conveniently, the screwdriver pen can be stored and carried in a breast pocket or, in any event, be readily versatile and available for use at points of need. Importantly, embodiments of the invention provide, as will become apparent from the description below, a screwdriver pen that can rotate and firmly press against screws when required without inadvertent retraction and have designs and configurations that render them comparatively easy to put together during assembly.

Figure 1:
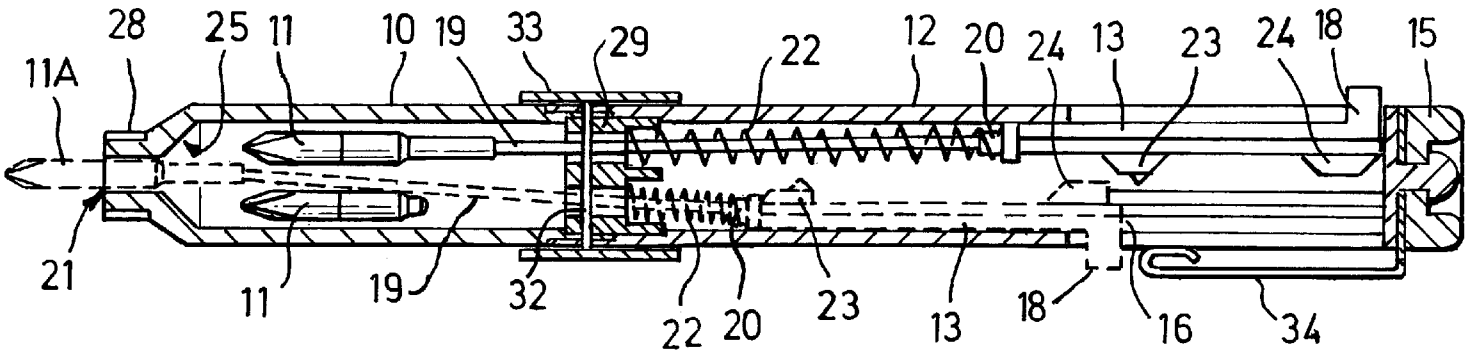
FIG. 1 is a sectional side view of the complete pen.
Figure 2:
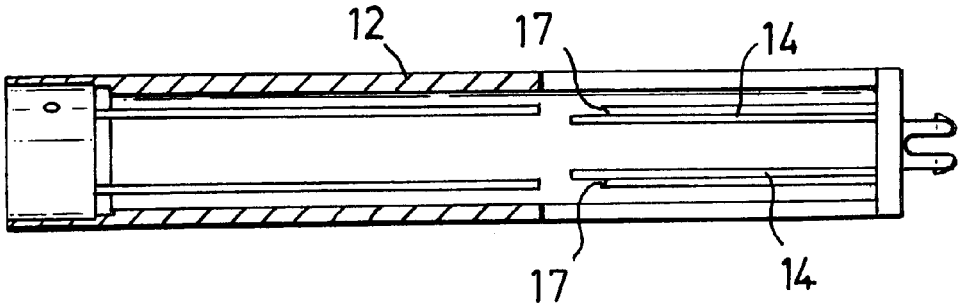
FIG. 2 is a sectional side view of a rear housing of the pen.

In FIGS. 1 and 2, a forward elongate cylindrical molded plastics housing 10 slidingly supports side by side within the housing four screwdriver heads 11. In the FIG. 1, one head 11A is shown dotted in a forward position and other heads 11 are in retracted positions. A similar separately formed rear elongate cylindrical housing 12, having the same external diameter as the forward housing, fits to and is joined end-to-end to the forward housing as will be explained later. The forward and rear housing are stepped where they join together so as to partially overlap. An actuator 13 for each head 11 slidingly fits in respective grooves 14 formed in the rear housing 12. A knob 15 is rotatably mounted at an end of the housing 12.

The actuators 13 each having a sloping ledge 16 at an inner side can be engaged against to mate with respective sloping stop 17 formed at the end of the groove 14. Raised lips 18 on the actuators 13 are provided to enable the actuator to be pushed forwards inside the rear housing using a finger tip or thumb.

A metallic push wire 19 is fixedly attached to each respective head 11 at one end and has a cap 20 at the other end. Thus, in use the actuators 13 are slid forwards to push against respective of the cap 20 to a respective screwdriver head 11 partially through an aperture 21 in a remote end of the front housing 10.

Coil springs 22 are mounted inside the rear housing surrounding each of the wires 19 and serve to bias the heads in a rearward direction. Thus, whenever an actuator 13 is released and slides away from its forward position, the respective head will be retracted by the bias of a coil spring 22 into the forward housing 10.

A releasable catch at the end of each actuator 13 comprises the angled ledge 16 opposite the lip 18. When an actuator 13 is in its forward position, the ledge 16 is pushed inwardly to engage a stop 17. The ledge and stop are angled to provide a mating plane. Because the mating plane is angled (i.e. not at at right angles to a longitudinal axis of the pen), any strain on the actuator 13 in a direction away from its operational forward position tends to press the ledge 16 more firmly against the stop 17. In other words, any rearward pressure against the actuator, normally as a result of pressing a screwdriver head against a screw in use, will tend to hold the actuator ledge 16 mechanically more positively in its latched configuration. This makes the operative function of the screwdriver pen secure even when considerable pressure is applied against a screw during turning of the screw. The ledge 16 normally holds the actuator in its forward position and the actuator can be released by pressing the actuator marginally further forward to allow the ledge 16 to spring outwards and away from the surface of the stop 17.

In normal use however, each actuator is released by pushing another actuator forwards, as occurs when another screwdriver head is selected. A cam 23 on a rear surface of each actuator engages a raised section 24, formed behind each ledge 16, of any actuator that is in its forward position as it moves forward. Thus, it will be appreciated from FIG. 1 that if another actuator (that is presently shown in its rear position) is slid forwards, its cam 23 will engage the raised portion 24 of the actuator shown dotted in its forward position. This releases the catch of the forward actuator, which will move rearward under the action of its spring 22 and make room for the other respective head 11 to be moved forwards into the aperture 21.

The heads 11 are each arranged to be pressed and held firmly forward in use by the metallic push wires 19, using the actuator catch as a firm hold, and this ensures significant pressure can be applied against a screw during screwing and unscrewing operations.

Figure 4:
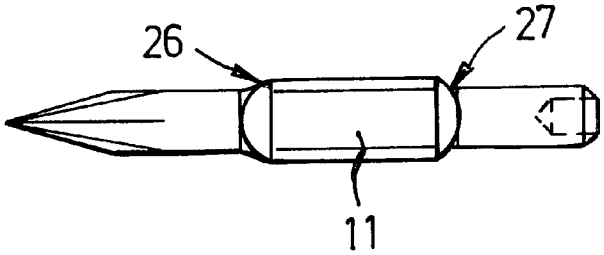
FIG. 4 is an enlarged side view of a screwdriver head.

An inner surface 25 of the forward housing is chamfered so that in use the heads 11 are guided into the aperture 21 when they are pushed forward for use. Outer forward surfaces 26 (see FIG. 4) are chamfered also to aid such guidance into the aperture 21. The angled surfaces 26 also act to prevent jamming of any head moving rearwards out of the aperture towards a retracted position. For further improvement in this respective, outer rearward surfaces 27 of each head are chamfered as well.

A metal reinforcing band 28 surrounds the forward housing opposite the aperture 22 to provide additional strength in this region. In practice, turning forces must be transferred by engagement between the outer surfaces of the heads 11 and inner corresponding surfaces of the aperture itself. Provision of the band 28 significantly increases the maximum turning force that can be applied in without straining the forward housing 10 in the region of the aperture 21.

It will be appreciated that for use by an electrician for example, one or more of the screwdriver heads 11 may be formed of non-metallic material. This allows the head to be used for tuning an electrical coil, for example, which requires turning a screw head in the coil. For such applications, or others, the band 28 may be also formed of non-metallic material.

The cross-section and outer shape of the screw heads and the aperture may be varied and made suitable for various screw heads as required. However, especially for miniature screwdriver heads, the preferred cross-section of the aperture is square or hexagonal.

Figure 3:
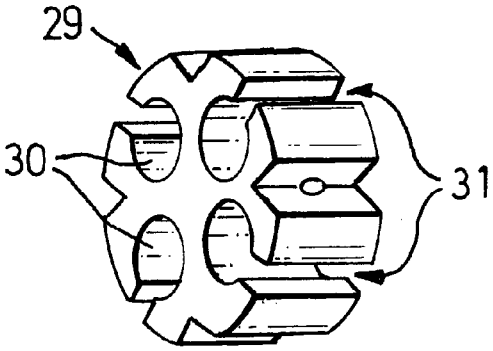
FIG. 3 is an elonged isometric view of a connecting collar.

The forward and rear housings 10 and 12 are held together and in line by an annular apertured collar 29, more clearly shown in FIG. 3. There are four apertures 30 for separating and guiding each of the four push wires 19. It will be noted that each aperture has a slot 31 extending to the peripheral surface of the collar 29. During assembly of the pen, the screwdriver heads are slid into the forward housing with push wires 19 and caps 20 already firmly attached. The collar 29 is then entered into the forward housing while the slots allow the wires 19 to be entered into the apertures 30 from outside the periphery of the collar 29. The rear housing 12 is then fitted to the forward housing and a laterally extending pin 32 is pushed through holes provided in the housings and the collar 29. The pin 32 thus extends the collar 26 to hold a joint between the housings together. The pin 32 is normally a tight fit but in any event is held in position by an outer band 33 that surrounds the joint. The pin 32 in particular also serves to prevent relative rotation between the housings 10 and 12 so that turning forces, in either direction, can be transferred between the housings without loosening or straining the joint.

A pocket spring clip 34 is attached to the rear housing 12.

I claim:

1. A screwdriver pen comprising a plurality of different screwdriver heads slidingly supported side by side in a forward elongate housing, a separately formed rear housing that is joined end-to-end to the forward housing and contains for each head a manually operable longitudinally relatively slidable actuator for pushing the head forwards so as to be partially exposed for use out of a remote end of the forward housing, in which an aperture in the remote end is formed to engage over and to rotatable grip the screwdriver head so that turning of the forward housing turns the screwdriver head whenever the screwdriver head is partially exposed, and including a push wire for each screwdriver head that extends between the head and the actuator, and releasable catch means for catching each actuator when each actuator is in a forward position, in which the housings are formed of molded plastics material and a reinforcing band is mounted externally of the forward housing surrounding the remote end aperture.

2. A screwdriver pen according to claim 1, in which the forward and rear housing are connected together by a laterally extending pin that prevents relative rotation between the housings.

3. A screwdriver pen according to claim 1 further comprising a spring for each head arranged to bias the head towards a rear position inside the forward housing so that in use whenever the actuator is released the head retracts from the partially exposed position automatically under the bias of the spring.

4. A screwdriver pen according to claim 1 further comprising an apertured annular collar that fits inside the housings for separatingly locating and guiding the push wires in a respective collar aperture, in which each collar aperture has a slot extending from the collar aperture to allow the push wires to enter the remote aperture sideways from outside the collar.

5. A screwdriver pen according to claim 1 wherein inner surfaces adjacent the remote aperture are chamfered so as to provide guiding surfaces for the heads as they are moved forwards towards the remote aperture.

6. A screwdriver pen according to claim 1 wherein external forward surfaces of each head are chamfered for guiding the head into the remote aperture whenever the screwdriver head moves forwards towards the remote aperture.

7. A screwdriver pen according to claim 1 wherein external rearward surfaces of each head are chambered.

8. A screwdriver pen according to claim 1 wherein the releasable catch means each comprise a ledge on a side of the actuator and a stop fixed in relation to the rear housing, the ledge and the stop having surfaces that can mate against one another to hold the actuator in the forward position, a first axis parallel to the forward direction in which a plane of at least one of mating surfaces extends in a non-perpendicular axis relative to the first axis so that strain on the actuator away from the forward position presses the mating surfaces more firmly against one another.

9. A screwdriver pen according to claim 8, in which both the mating surfaces lie along the same plane.

10. A screwdriver pen comprising a plurality of different screwdriver heads slidingly supported side by side in a forward elongate housing, a separately formed rear housing that is joined end-to-end to the forward housing and contains for each head a manually operable longitudinally relatively slidable actuator for pushing the head forwards so as to be partially exposed for use out of a remote end of the forward housing, in which an aperture in the remote end is formed to engage over and to rotatably grip the screwdriver head so that turning of the forward housing turns the screwdriver head whenever the screwdriver head is partially exposed, and including a push wire for each screwdriver head that extends between the head and the actuator, and releasable catch means for catching each actuator when each actuator is in a forward position, including an apertured annular collar that fits inside the housings for separatingly locating and guiding the push wires in a respective collar aperture, in which each collar aperture has a slot extending from the collar aperture to allow the push wires to enter the remote aperture sideways form outside the collar.

11. A screwdriver pen according to claim 10 wherein inner surfaces adjacent the remote aperture are chamfered so as to provide guiding surfaces for the heads as they are moved forwards towards the remote aperture.

12. A screwdriver pen according to claim 10 wherein external forward surfaces of each head are chamfered for guiding the head into the remote aperture whenever the screwdriver head moves forwards towards the remote aperture.

13. A screwdriver pen according to claim 10 wherein external rearward surfaces of each head are chambered.

14. A screwdriver pen according to claim 10 wherein the releasable catch means each comprise a ledge on a side of the actuator and a stop fixed in relation to the rear housing, the ledge and the stop having surfaces that can mate against one another to hold the actuator in the forward position, a first axis parallel to the forward direction in which a plane of at least one of mating surfaces extends in a non-perpendicular axis relative to the first axis so that strain on the actuator away from the forward position presses the mating surfaces more firmly against one another.

15. A screwdriver pen according to claim 14 in which both the mating surfaces lie along the same plane.

* * * * *